US007872416B2

(12) United States Patent
Hartmann

(10) Patent No.: US 7,872,416 B2
(45) Date of Patent: Jan. 18, 2011

(54) ELECTROLUMINESCENT DISPLAY

(75) Inventor: Manfred Hartmann, Ziegelberg/Petershausen (DE)

(73) Assignee: Schreiner Group GmbH & Co. KG (DE)

( * ) Notice: Subject to any disclaimer, the term of this patent is extended or adjusted under 35 U.S.C. 154(b) by 652 days.

(21) Appl. No.: 10/594,330

(22) PCT Filed: Apr. 4, 2005

(86) PCT No.: PCT/EP2005/003536

§ 371 (c)(1),
(2), (4) Date: Jun. 6, 2007

(87) PCT Pub. No.: WO2005/098891

PCT Pub. Date: Oct. 20, 2005

(65) Prior Publication Data

US 2007/0284992 A1 Dec. 13, 2007

(30) Foreign Application Priority Data

Apr. 5, 2004 (DE) ..... 10 2004 016 709

(51) Int. Cl.
*H01J 1/62* (2006.01)
*H05B 33/00* (2006.01)

(52) U.S. Cl. ..... 313/509; 313/506; 313/512; 313/510; 313/505

(58) Field of Classification Search ..... 313/506–509
See application file for complete search history.

(56) References Cited

U.S. PATENT DOCUMENTS 2,922,076 A * 1/1960 Asars et al. ..... 315/71
3,890,039 A * 6/1975 Cantarano ..... 399/130
4,482,841 A 11/1984 Tiku et al.
5,069,815 A * 12/1991 Aoki et al. ..... 252/301.36
5,410,217 A * 4/1995 LaPointe ..... 313/509
5,686,792 A * 11/1997 Ensign, Jr. ..... 313/509
5,821,691 A * 10/1998 Richie et al. ..... 313/506
6,142,643 A 11/2000 Araki et al.

(Continued)

FOREIGN PATENT DOCUMENTS

DE 691 20 864 T2 2/1997

(Continued)

*Primary Examiner*—Sikha Roy
(74) *Attorney, Agent, or Firm*—Studebaker & Brackett PC; Donald R. Studebaker

(57) ABSTRACT

An electrode layer (2) formed by a transparent conductive varnish is applied to a mineral or plastic glass carrier. Afterwards, a luminescent layer (3) formed by a transparent matrix (5) provided with electroluminophors (4) incorporated therein is disposed within contours defining an image surface. Said luminescent layer (3) is dividable into several discrete partial areas. A rear silver-containing electrode layer (7) extends within the a luminescent layer (3) contours above a surface whose size is approximately equal to the size of the luminescent layer (3) but leaves a narrow edge area (8) thereof free. The structure also comprises an insulating transparent layer (9) provided with recesses (10) in the area of the rear electrode layer (7) in order to bring it into contact for voltage supply from a rear face. Said rear electrode layer (7) is brought into contact through the recesses (10) of the insulating layer (9) by means of a transparent conductive varnish contact layer (12). The inventive electroluminescent display is insulated on the rear face thereof by a rear transparent insulating layer (14).

14 Claims, 1 Drawing Sheet

U.S. PATENT DOCUMENTS

| | | | | |
|---|---|---|---|---|
| 6,965,196 | B2 * | 11/2005 | Murasko et al. | 313/506 |
| 6,998,774 | B1 * | 2/2006 | Barnardo et al. | 313/509 |
| 7,088,039 | B2 * | 8/2006 | Barnardo et al. | 313/510 |
| 2001/0019243 | A1 | 9/2001 | Hidler | |

FOREIGN PATENT DOCUMENTS

| | | | |
|---|---|---|---|
| DE | 199 14 081 | A1 | 9/2000 |
| EP | 0 415 372 | A2 | 3/1991 |
| EP | 0 455 401 | B1 | 7/1996 |

* cited by examiner

ELECTROLUMINESCENT DISPLAY

BACKGROUND OF THE INVENTION

1. Field of the Invention

The present invention relates to an electroluminescent display.

2. Description of the Related Art

An electroluminescent display (EL display) is understood as a flat body which has a luminescent layer, containing at least one electroluminophore, i.e., a material which luminesces due to excitation using an electrical (AC) field, incorporated in a binder matrix, over at least part of its area. EL displays are used particularly as advertising panels having luminescent display areas. In addition, there are multiple applications as visual aids, displays, decorative elements, light fixtures, etc.

The electroluminophores or luminescent pigments are embedded in a transparent, organic or ceramic binder. The starting materials are typically zinc sulfides, which generate different, relatively narrow-band emission spectra as a function of doping and/or co-doping and preparation procedure. The focus of the spectrum determines the particular color of the emitted light.

In connection with the present application, transparent is understood as the opposite of opaque, i.e., as recognizably transparent to light and/or noticeably translucent as used in general speech. Therefore, transparent as defined here does not require light transmission of nearly 100%. A light transmission of 15% would also still be considered transparent. Only slight light transparency, i.e., a degree of transmission which solely allows light sources to glimmer through weakly, in contrast, is no longer understood as transparent.

The exciting AC voltage field typically has a frequency of a few hundred hertz, the effective value of the operating voltage frequently being in a range from approximately 50 to 150 volts. By elevating the voltage, a higher light density may normally be achieved, which is typically in a range from approximately 50 to approximately 200 candela per square meter. Elevating the frequency usually causes a color shift toward lower wavelengths. Both parameters must be tailored to one another in order to achieve a desired light impression, however.

The AC field is applied via thin planar electrodes, which are situated on both sides of the luminescent layer and are implemented as transparent at least on the viewing side. The electrodes layers form a planar luminescent capacitor together with the luminescent layer and possibly additional dielectric layers and/or color-filtering or color-converting layers.

For practical and design reasons, the luminescent layers of EL displays are usually implemented as a large number of non-coherent partial areas, which are each used as display segments and/or pixels. The individual display segments and/or pixels may be implemented in various colors and in greatly varying shapes and are referred to in general in the following as "partial image areas". At least one of the electrodes layers is usually also implemented only in the area of the partial image areas, particularly, however, if partial image areas are to be individually activatable, for example, for movie-like effects, blinking effects, changing display texts, etc.

Typical EL displays, in particular EL displays used as advertising signs or visual aids, normally have a construction comprising two conductively coated glass or plastic panes, the luminescent capacitors being situated between the panes, which are contacted on their rear faces via carbon zebra strips, for example.

Large-area displays in particular are relatively complex to produce, since two largely rigid panes have to be handled during the manufacturing. The weight of the finished display is also significant due to the two panes.

SUMMARY OF THE INVENTION

Before this background, it is the object of the present invention to provide an EL display which may be implemented as a single-pane construction without impairing its function and appearance in relation to typical EL displays. Furthermore, the EL display is to be simple to manufacture and reliable to operate. A high-quality impression is also desirable, i.e., elements which do not contribute to the actual information display and/or decorative effect, such as printed conductors and the like, are to be able to be implemented as unobtrusively as possible.

This object is achieved by an electroluminescent display according to claim 1. Advantageous embodiments may be implemented according to one of claims 2 through 13.

The rear contact layer, which is preferably made of transparent conductive varnish, ensures the contacting of the rear electrode layer, which preferably contains silver or carbon, in the region of the image area without visible printed conductors. The contact layer preferably contacts the rear electrode layer directly in the area of the recess or recesses of the insulation layer, i.e., without an intermediate layer. If the image area is divided into multiple non-coherent partial image areas, e.g., display segments, letters, etc., the contact layer may be segmented into contact areas which are separated from one another by narrow interruptions to allow the separate electrical activation and thus luminescence of the partial image areas independently of one another. The transparent conductive varnish may be, for example, (doped) polythiophene, which is available under the trade name Orgacon (registered trademark of the Agfa-Gevaert group), for example. Transparent is understood as defined above. However, transparent layers according to the present invention preferably allow a light transmission of at least 25%, especially preferably above 40%, ideally above 60%.

The carrier is preferably a glass or plastic glass pane, which may be implemented as transparent or partially transparent. Partially transparent is understood to include both regionally transparent carriers and also non-transparent and nonetheless noticeably translucent carriers (e.g., made of milk glass or sandblasted glass). A wide variety of mineral and organic glasses are suitable, in addition to typical or tempered window glass, for example, acrylate glass (PMMA) or polycarbonate glass. The carrier is preferably the single supporting layer predominantly made of glass or plastic glass in the construction of the EL display; multilayer safety glass is viewed in this context as one layer. In this context in particular, layers which have a specific minimum flexural strength, for example, a flexural strength according to DIN 53 121 of more than 100 mNm (lengthwise), may be understood as a supporting layer. In this context, a luminescent layer having acrylate binders (implementation of the matrix like artificial glass in which the luminophores are incorporated) is not understood as a supporting plastic glass layer. Rather, dispensing with a second supporting glass or artificial glass layer means that the construction, in contrast to the above-mentioned prior art, is not constructed on two, but rather only one conductively coated pane. Significant weight savings may be achieved in this way in relation to known EL displays, furthermore, the thickness of the overall construction is also reduced. For the same purpose, the insulating layer is preferably thinner than one millimeter. Moreover, the insulating layer is preferably made of plastic.

The electrode layer, which rests on the carrier or possibly an intermediate layer, is preferably also implemented from transparent conductive varnish. However, a different type of transparent, conductive coating of the carrier is also conceivable, such as sputtering using indium-tin oxide (ITO). Suitable glasses coated with tin oxide are commercially available at relatively low prices.

The voltage supply of the contact layer and the electrode layer may be performed via busbars. These are highly conductive structures made of silver and/or copper and/or carbon pastes or the like around the edge and/or (partially) around the border.

On the rear face, the EL display is preferably insulated using a rear insulating layer, which may advantageously comprise a thin plastic film, a nonconductive varnish, or the like. If both this and also the insulating layer situated on the side of the contact layer facing toward the carrier are implemented as transparent, an EL display which is transparent outside the image areas is provided, in which, because of the transparency of the contact layer, no electrical conduction elements interfere with the visual impression (possibly provided busbars may be provided on the edge of the EL display and therefore covered using a frame or a clamping device for a narrow, viewing-side, opaque cover around the border). If necessary, suitable recesses are to be provided in the insulating or rear insulating layered provided to contact the busbar.

In principle, any variation of the present invention described or indicated in the scope of the present application may be advantageous depending on the economic and technical conditions in the specific case. If not described otherwise and/or insofar as technically implementable in principle, individual features of the embodiments described are replaceable or combinable with one another.

BRIEF DESCRIPTION OF THE DRAWINGS

Examples of preferred embodiments of the present invention are described in greater detail on the basis of the attached drawing. The figures of the drawing are not to scale and are purely schematic.

DESCRIPTION OF THE PREFERRED EMBODIMENTS

Figure 2E:
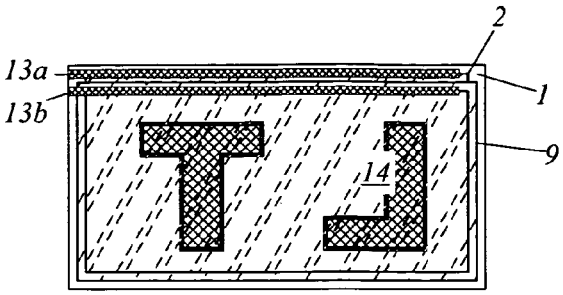
FIGS. 2*a*-2*e* show different layers of an EL display according to the present invention, constructed similarly to FIG. 1, in a rear view, i.e., sections parallel to the image plane of the EL display. The figures may also be understood as illustrations of different steps of the manufacture of the EL display.
Figure 2D:
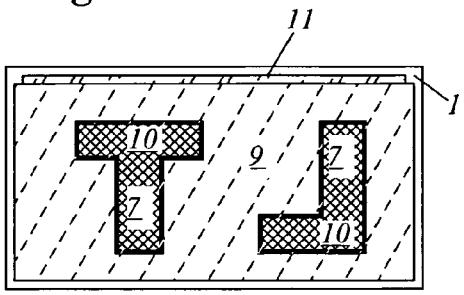
Figure 2C:
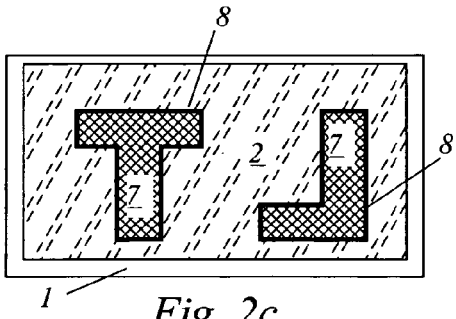

FIG. 1 and FIGS. 2*a*-*e* show layer constructions which are largely identical to one another, so that the same reference numerals are used in each case for components corresponding to one another. The figures may be viewed in parallel, the layer construction in FIG. 1 being explained from bottom to top and thus in the production sequence of the individual layers. The viewing side, i.e., the side facing toward the intended observer, is shown on the bottom in FIG. 1, the rear is shown on top.

Figure 2B:
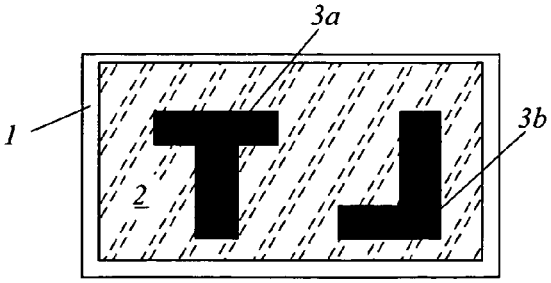
Figure 1:
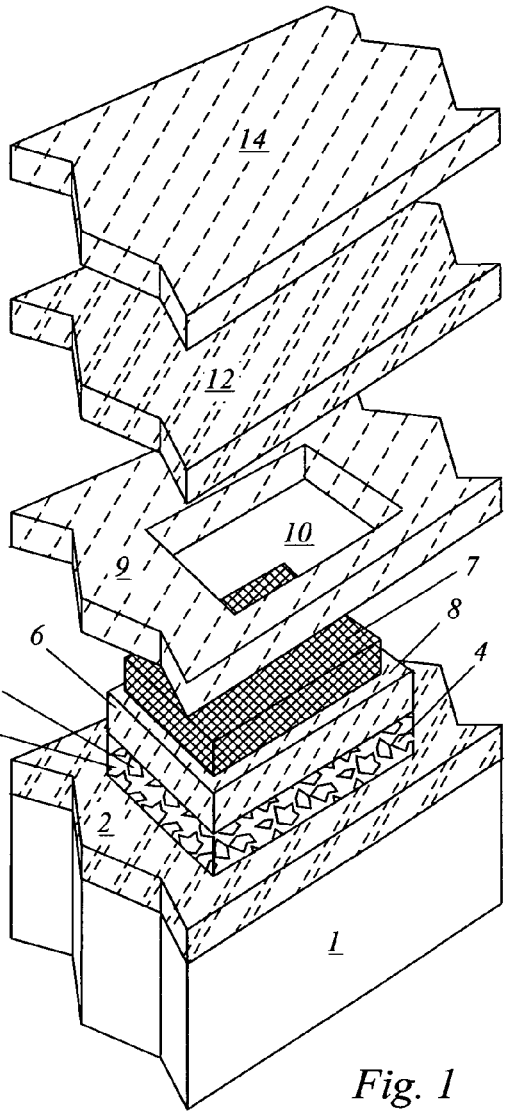
FIG. 1 shows a perspective view of a section through a part of an EL display according to the present invention. For reasons of clarity, the layer thicknesses are greatly enlarged and gaps are sometimes shown between adjoining layers like an exploded drawing.
Figure 2A:
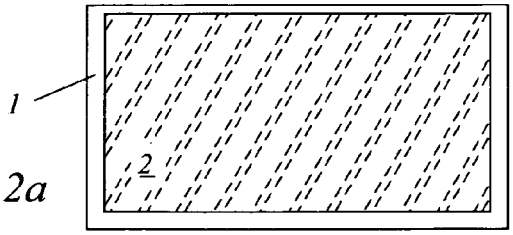

The electrode layer 2 made of transparent conductive varnish is applied to a carrier 1 made of mineral or plastic glass (FIG. 2*a*). The luminescent layer 3 is situated thereon inside the contours which are to result in the image area, this being a transparent matrix 5 in which the electroluminophores 4 are incorporated. The layer 3 may be implemented as a cast or extruded film, but also as a screenprinted layer or the like. The illustration of the electroluminophores 4 in particular is to be understood as purely schematic. In practice, the particles are to approximate a spherical shape as much as possible.

Electroluminophores are typically sensitive to the effects of moisture. Therefore, additional layers may be integrated, which assume the function of a moisture barrier or vapor barrier. However, these may be largely dispensed with in particular if microencapsulated electroluminophores 4 are used. The microencapsulation is typically oxidic or nitridic, but an organic microencapsulation or a diamond-like carbon encapsulation is also conceivable, for example.

The luminescent layer 3 may be divided into multiple discrete partial areas 3*a*, 3*b*, as shown in FIG. 2*b*, which each represent individual image elements, display segments, symbols, or characters (in the present case in the form of the letters L and T). A thin additional dielectric layer 6 may advantageously be provided on the rear face of the luminescent layer 3. The rear electrode layer 7, which contains silver but may also be implemented differently in principle, extends within the contours of the luminescent layer 3 or its discrete partial areas 3*a*, 3*b* over an area which is approximately as large as the area of the luminescent layer 3 or its discrete partial areas 3*a*, 3*b*, but leaves a narrow edge area 8 of the latter or the dielectric layer 6 free in order to preclude a danger of breakdown (in connection with the electrode layer 2) as much as possible.

A transparent insulating layer 9, which preferably comprises a plastic material, is provided as the next layer in the construction, which has recesses 10 in the area of the rear electrode layer 7 and in a narrow edge area 11 of the electrode layer 2 in order to allow its contacting from the rear for the voltage feed.

The contacting of the rear electrode layer 7 through the recesses 10 of the insulating layered 9 occurs via the contact layer 12 made of transparent conductive varnish, which is implemented over almost the entire area, but does not extend entirely to the narrow edge area 11 to contact the electrode layer 2, in order to preclude short-circuits. The contacting advantageously occurs directly, i.e., without additional layers between contact layer 12 and rear electrode layer 7. The voltage feed into the contact layer 12 and electrode layer 2 occurs via busbars 13*a*, 13*b*, which may be printed from silver conductive paste, for example, and are not implemented as peripheral in the present case because of aesthetic aspects. In very large-area EL displays, however, busbars which extend around nearly the entire circumference may be advantageous to achieve a uniform light density and to avoid local heating.

The EL display is insulated on the rear by the transparent rear insulating layer 14, which preferably comprises a plastic material.

Of course, EL displays according to the present invention may also have additional, non-luminescent image components or image components which are backlit using the luminescent layer 3, for example, in the form of imprints, glass etching, etc.

What is claimed is:

1. An electroluminescent display, comprising:

an at least partially transparent carrier, a transparent electrode layer situated on the carrier, a luminescent layer, containing electroluminophores, which represents an image area, a rear electrode layer in a region of a majority of the image area, an insulating layer, which has a recess in an area of the rear electrode layer, the rear electrode layer as a whole being situated in the recess and electrically isolated by the insulating layer, and a transparent contact layer situated on at least part of the area of the insulating layer for contacting the rear electrode layer.

2. The electroluminescent display according to claim 1, wherein the transparent electrode layer is made from transparent conductive varnish.

3. The electroluminescent display according to claim 1, wherein the contact layer is made from transparent conductive varnish.

4. The electroluminescent display according to claim 1, wherein the insulating layer is least partially transparent.

5. The electroluminescent display according to claim 1, having a rear insulating layer for insulating a side of the contact layer facing away from the carrier.

6. The electroluminescent display according to claim 5, wherein the rear insulating layer is at least partially transparent.

7. The electroluminescent display according to claim 1, wherein the carrier predominantly consists of glass or plastic glass.

8. The electroluminescent display according to claim 7, wherein the carrier represents a single supporting layer of the electroluminescent display predominantly consisting of glass or plastic glass.

9. The electroluminescent display according to claim 1, wherein at least one of the electrode layer and the contact layer is contacted using its own busbar.

10. The electroluminescent display according to claim 9, wherein the busbar is implemented with a conductive paste included.

11. The electroluminescent display according to claim 1, wherein the image area is divided into multiple non-coherent partial image areas.

12. The electroluminescent display according to claim 11, wherein the partial image areas are each capable to be activated individually.

13. The electroluminescent display according to claim 11, wherein the partial image areas are each capable to be activated in groups.

14. The electroluminescent display according to claim 1, wherein the contact layer contacts the rear electrode layer directly in the region of the recess.

* * * * *